US005170838A

United States Patent [19]

Theler et al.

[11] Patent Number: 5,170,838

[45] Date of Patent: Dec. 15, 1992

[54] PROGRAM-CONTROLLED FEEDING OF MOLTEN METAL INTO THE DIES OF AN AUTOMATIC CONTINUOUS CASTING PLANT

[75] Inventors: Jean-Jaques Theler, Sierre; Jean-Francois Jordan, Venthône; Edmond Rey, Sierre, all of Switzerland

[73] Assignee: Alusuisse-Lonza Services Ltd., Zurich, Switzerland

[21] Appl. No.: 674,705

[22] Filed: Mar. 25, 1991

[30] Foreign Application Priority Data

Mar. 26, 1990 [CH] Switzerland ..... 989/90

[51] Int. Cl.[5] ..... B22D 11/07; B22D 11/10; B22D 11/16

[52] U.S. Cl. ..... 164/452; 164/150; 164/154; 164/420; 164/451; 164/472; 164/489

[58] Field of Search ..... 164/452, 451, 472, 487, 164/489, 150, 154, 420

[56] References Cited

U.S. PATENT DOCUMENTS 4,057,100 11/1977 Lossack et al. ..... 164/472 X
4,597,432 7/1986 Collins et al. ..... 164/487 X
4,664,175 5/1987 Yanagimoto et al. ..... 164/452 X
4,804,037 2/1989 Nomura et al. .
4,875,519 10/1989 Ishii et al. ..... 164/487 X

FOREIGN PATENT DOCUMENTS 555574 3/1957 Belgium .
0218855 4/1987 European Pat. Off. .
2508529 12/1982 France .

*Primary Examiner*—J. Reed Batten, Jr.
*Attorney, Agent, or Firm*—Bachman & LaPointe

[57] ABSTRACT

Upstream of the dies (14) internally insulated in the upper region is a casting furnace and a runner system, which latter comprises a distributor through feeding all the dies (14) with metal at an identical level (60). In the region situated below an inner ring (32), a gas cushion (54) which prevents direct contact of the die (14) with the molten metal (30) is maintained, and oil is injected into this region. A joint main having distribution lines conducts air or an inert gas having the same, slight overpressure into all the dies (14). The relative pressure between a desired value dependent on the metal level ($H_1$) and computed by program and an actual value measured in the main (62) serves for regulation and monitoring. Upon overshooting of the programmed, maximum deviation of the controlled variable, a processor triggers a manipulated variable for the actuator of the pressure control valve.

17 Claims, 3 Drawing Sheets

PROGRAM-CONTROLLED FEEDING OF MOLTEN METAL INTO THE DIES OF AN AUTOMATIC CONTINUOUS CASTING PLANT

The invention relates to a process and a device for feeding molten metal into the dies, internally insulated in the upper region, of an automatic continuous casting plant having an upstream casting furnace and a runner system, which comprises a distributor trough feeding all the dies with metal at the same level, a gas cushion that prevents direct contact of the die with the metal being maintained in the region situated below an inner ring, and oil being injected into this region. The invention further relates to an application of the process.

In the continuous casting process, metals are cast in the form of bars or bolts several meters in length, which are used as raw material for various subsequent processing steps such as, for example, pressing, rolling or forging.

The most important element of a continuous casting machine are the dies, which in conventional processes determine the cross-section of the cast strand. A casting machine is fitted, depending upon the number of cast strands, with a corresponding number of withdrawable stopping bases which are firmly connected to a die frame.

During the continuous casting, the molten metal flows, possibly with the insertion of at least one filter, through a runner system from the casting furnace into the casting machine, where it is distributed into the individual dies.

While the dies are slowly filling with the melt, the metal begins to solidify on the dried stopping bases. The stopping bases are subsequently cooled and withdrawn at a rate such that the solidus of the solidified metal always remains within the die frame. The strands, whose solidification is accelerated by water cooling, grow downwards to the same extent as the stopping bases are withdrawn. The casting process is free from interruption within the prescribed length of a strand.

One of the essential disadvantages of conventional continuous casting processes consists in that the level must be separately controlled in each individual die, and that long dies are necessary. The secondary effects resulting therefrom lead to a lower surface quality.

Accordingly, the so-called hot top process, in which the metal flows into a distributor trough (hot top) feeding all the dies to an identical level, was developed quite some time ago. The level controlling devices of all the individual dies can be omitted and replaced by a central controlling element, which permits a smoother metal surface and a simplified casting process.

The conventional hot top casting process has been further developed, through the formation of a gas cushion with automatic lubrication, into a semi-continuous casting process in which a direct contact between the liquid metal and the die is prevented by virtue of the air cushion and of an oil film in the uppermost region.

The compressed air for the formation of the gas cushion is introduced in the upper part of the die, below an inner insulation. By comparison with the conventional hot top casting process, the following additional advantages can be achieved with a gas cushion, in particular in cooperation with an oil film:

Due to the milder cooling conditions, surface segregations and hidden cold sets are largely prevented.

Due to the lower construction of the dies, segregation and the flowing out of melt through small openings in the already solidified metal mantle are prevented.

Friction and breakages are prevented, because the contact surface between the metal and the die is shorter due to the gas cushion and the lubricant is distributed more effectively.

U.S. Pat. No. 4,157,728 describes a hot top continuous casting process of the abovementioned type, an annularly circumferential air cushion being formed below the hot top. This requires a slight overpressure. The adjustment of the overpressure is performed manually, by means of a screw.

The supply of air and oil is performed in the same region, but separately.

Further improvements of the process have been sought recently, particularly in the direction of the so-called air slip process, such as is described in U.S. Pat. No. 4,598,763. The upper inner region of a die is designed with an open-pore graphite ring. Air and oil can be conducted into the die interior mixed or separately via the pores of the graphite ring. Graphite is self-lubricating, the oil is added not first and foremost as a lubricant, but as a pore filler. Water is sprayed on only below the graphite ring.

A very mild, that is to say advantageous cooling can be achieved with a graphite ring through which air and oil flows. The use of a graphite ring has the disadvantage, however, of being expensive and complicated for automation of the corresponding casting process.

It is the object of the present invention to create a process and a device of the type mentioned at the beginning which permit a more thoroughgoing automation of the hot top casting process.

With reference to the process, the object is achieved according to the invention when a joint main having distribution lines conducts air or an inert gas having the same, slight overpressure into all the dies, and the relative pressure between a desired value computed by program as a function of the metal level measured via a level probe and an actual value measured in the main by means of a measuring transducer serves for program-controlled regulation and monitoring, in that the regulating function is fulfilled by means of a processor through the output of a signal for the actuator of a joint pressure control valve.

Nitrogen and/or argon, for example, are used as inert gases. However, for reasons of cost air is used as a rule, for which reason the designation air also includes inert gases in the following discussion for the sake of simplicity.

The level of the metal surface can be measured by means of a level probe of a design known per se, or else by means of a laser sensor. Because of the large diameter, the actual pressure measured in the main displays no fluctuations in the case of small pressure losses.

The external pressure, which varies considerably depending upon the weather situation, should not influence the casting process. According to a preferred embodiment of the invention, the influence of the variable external pressure is therefore automatically compensated with the aid of known means by using a conventional differential pressure gauge.

At the start of casting, there is no liquid metal in the die which sets up resistance to the flow of gas. A first higher value is adjusted by means of a flowmeter. When the liquid metal led thereupon into the die reaches the gas exit opening, the gas flow rate drops because the metallostatic resistance becomes successively higher. When the gas flow undershoots a second, lower value, the withdrawal of the die frame with the stopping bases for the cast strands is triggered after a short time. Without metal, an air flow of 12–15 Nl/min is achieved as first value; approximately 8–10 Nl/min is adjusted as second value for triggering the withdrawal via the flow rate difference. A few seconds, expediently approximately 5 seconds, after this second value has been reached, the withdrawal of the die frame begins. The flow regulation is performed by means of the relative pressure, the difference between the desired value and actual value for the pressure in the main.

Because of the low gas flow through the distribution lines branching off from the main, their length plays no role; all the dies are supplied under the same conditions.

The supply of all the dies with the same amount of oil, by contrast, was previously guaranteed only if the individual oil lines leading to the dies from the oil main were all of identical length. This is no longer a requirement today; all the dies can be supplied using known means with the same amount of oil per unit of time, independently of the line resistance.

The oil required for lubrication is preferably injected in pulses into the region of the gas cushion. Consequently, the oil can be injected with higher pressure, without the total consumption becoming too high.

The discharge ducts for the gas and the oil can be separate or united to form one duct.

The pressure in the gas cushion may not overshoot a specific maximum value, otherwise gas bubbles form in the metallic melt. However, the pressure of the gas cushion also may not undershoot a specific minimum value, otherwise the molten metal can penetrate into the gas supply ducts. The minimum and the maximum value for the pressure in the gas cushion vary in a linear fashion in relation to the respective metallostatic pressure in the die. The minimum pressure which may not be undershot corresponds to a function of the density $\rho$, the acceleration due to gravity g, the metal level above the gas exit openings, the interface strain of the melt in the region of insulation/die, and the surface tension of the melt in the region of the gas cushion. The maximum pressure in the gas cushion, which may not be overshot, is a function of the density of the melt $\rho$, the acceleration due to gravity g and the depth of the undercut of the insulation.

With reference to the device, the object is achieved according to the invention when it comprises a main for the gas supply having on the plant side a servo delivery valve and a measuring transducer as well as on the computer side a processor which compares the actual pressure controlled variables of the measuring transducer and the controlled variable of the desired pressure, and triggers a manipulated variable for the actuator of the pressure control valve.

The desired value is determined computationally on the basis of the metal level measured, for example, by means of a laser sensor.

The distribution lines branching off from the main to the dies consist, for example, of rubber or a plastic having an outer, reinforcing and protective metal cloth.

The main for the gas supply expediently has an internal diameter of 5–10 cm. The branching distribution lines preferably lead directly, without secondary lines, to the dies. The main is preferably oversize, i.e. the sum of the cross-section of all the distribution lines is substantially below the cross-section of the main, preferably at least 20%. It has already been mentioned that the distribution lines need not be of identical length. The cross-section means here, and throughout the present specification, the inner cross-section. So that a relatively higher tolerance remains between the minimum and maximum permissible pressure in the gas cushion, the lower rim of the insulation layer projecting beyond the die is preferably undercut. Approximately 10 mm have proved to be effective as the optimum value for this undercut, and this better enables a stable gas cushion to be formed. Although the undercut can assume any geometrical shape, it preferably progresses as a bevel with the shape of a lateral conical surface.

A possibly demountable laser sensor is expediently used as the level measuring instrument for determining the metal level, which is ubiquitously identical in the runner system and in the dies.

The application of the process according to the invention concerns first and foremost the automation of the startup and the end of the pour as well as the quality control during the stationary phase of continuous casting.

The invention is explained in more detail with reference to the exemplary embodiments, and are represented in the drawing, wherein.

Figure 1:
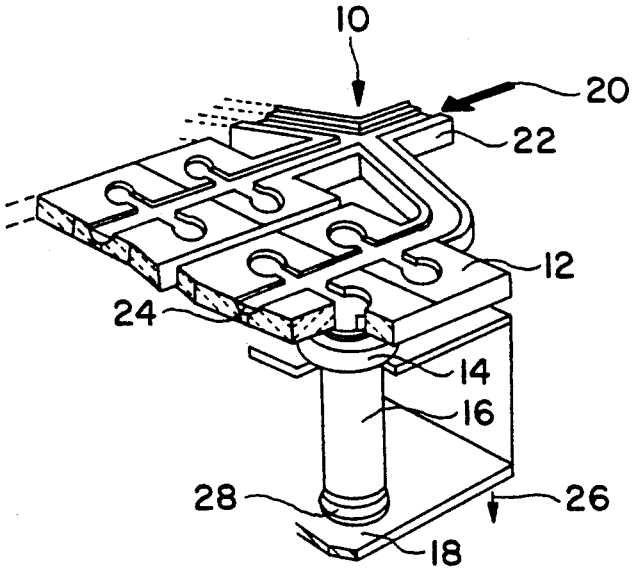
FIG. 1 shows a perspective partial view of a hot top casting machine.

The basic drawing represented in FIG. 1 of hot top continuous casting known per se essentially comprises a runner system 10, hot tops 12 consisting of a refractory material, dies 14, cast strands 16 and a die frame 18.

The runner system 10, in which the metal flows with an identical level in all the runners in the direction of the arrow 20, comprises a distributor trough 22. The latter serves as a reservoir for liquid metal. The individual runners merge into grooves 24 of the hot top 12. The grooves 24 also proceed in the transverse direction in accordance with the arranged dies 14, and merge above the dies 14 into bores through the hot top 12. This guarantees that the metal level need only be measured at one point. Within the measurement tolerances, this level is identical in the entire casting machine.

A number of stopping bases 28 corresponding to the number of dies 14 are arranged on the die frame 18, which is withdrawn in the direction of the arrow 26.

Figure 2:
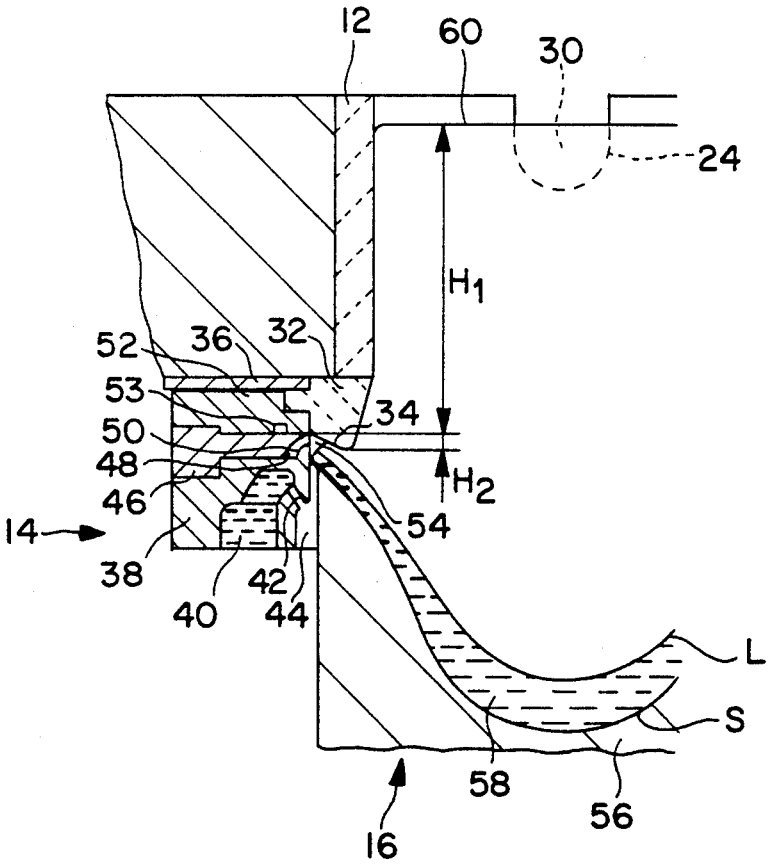
FIG. 2 shows a partial vertical section through the die region of a hot top casting machine.

FIG. 2 shows a hot top 12, a die 14 and a cast metal strand 16 in detail.

As represented in FIG. 1, the hot top 12 leads the molten metal 30 into the dies 14 via grooves 24. The hot top 12 consists of refractory insulating material.

In the upper inner region, the die 14 consisting of three rings has an annular inner insulation 32, which prevents contact of the molten metal 30 with the upper region of the die 14.

In the lower region, the insulation 32 has an undercutting bevel 34. The insulating ring 32 consisting of a refractory material is pressed onto the die 14 by means of a pressure plate 36. An O-ring (not represented) guarantees tightness between the die 14 and the insulating ring 32.

The inner surface of a lower die ring 38 determines the diameter of the strand 16. Water 44 is sprayed onto the strand 16 via ducts 42 from the annularly constructed water reservoir 40.

A middle die ring 46 contains an annular oil chamber, which is delimited by the lower die ring 38 and has discharge ducts 50 which open out immediately below the inclined surface 34 of the insulating ring 32. The oil chamber 48 is fed via radial ducts (not represented), which are cut out from the lower ring 38 or from the middle ring 46, and are delimited by the respective other ring.

An upper die ring 52 contains an annular air chamber 53 having radial tap ducts between the middle and the upper die ring.

The air is led with a slight overpressure, in the region of approximately 45 mbar, immediately below the bevel 34 of the insulating ring 32 into the die interior. In this process, an annular air cushion 54 is produced. The latter mitigates the cold shock of the molten metal 30 impinging on the die 14.

Air and oil are discharged in the same region in the annular air or gas cushion 54, separately in the present case.

A pasty region 58 having a mixture of liquid and solid phases forms between the molten metal 30 and the solidified part 56 of the strand 16, between the liquidus surface L and the solidus surface S.

The vertical distance between the joint level 60 of the molten metal 30 in the runner system 10, the grooves 24 and the die 14 and the transition of the bevel 34 of the insulating ring 32 onto the die 14, in the region of the air discharge ducts, is denoted as the metal level $H_1$. The metal level $H_1$ is in the range from 200 mm. The insulating ring 32 has a bevel depth $H_2$ of approximately 10 mm. The sum of $H_1+H_2$ is denoted by H.

For the reasons mentioned above, the pressure in the air cushion 54 may not undershoot the metallostatic pressure at the depth $H_1$, multiplied by the interface strain and surface tension, and may not overshoot at the depth H.

Figure 3:
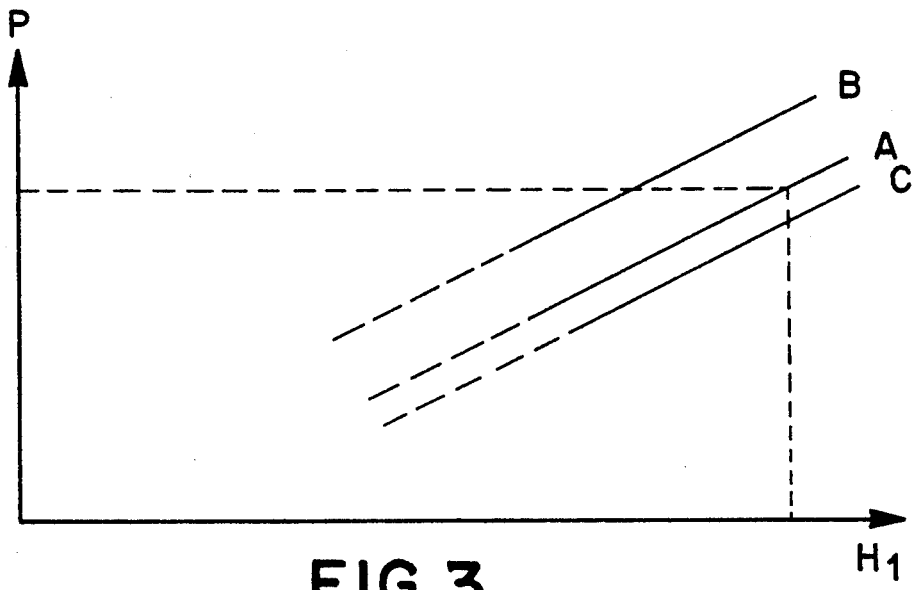
FIG. 3 shows curves for the metallostatic pressure as a function of the metal level.

The metallostatic pressure is plotted in FIG. 3 as a function of the metal level $H_1$. The metallostatic pressure p is computed as follows:

$$p=\rho g H_1,$$

where $\rho$ is the density of the molten metal, which depends on the alloy and the temperature, and g corresponds to the locally constant acceleration due to gravity. The values computed according to this formula are drawn in on the curve C in FIG. 3.

The values measured for optimum casting conditions are plotted on the curve A, which is situated slightly above the theoretical curve C. The distance is approximately 2 mbar. Finally, the values for the incipient bubble formation have further been inserted in curve B. Theoretically, the bubble formation begins when, with the addition of the already mentioned interface strain and surface tension in the above formula, H is inserted into the above formula instead of $H_1$, it being the case that $H=H_1+H_2$ (FIG. 2).

FIG. 3 can be used in practice in order to read off the optimum pressure to be applied in the case of a given metal level. As already mentioned, this pressure is at or just under 50 mbar.

Figure 4:
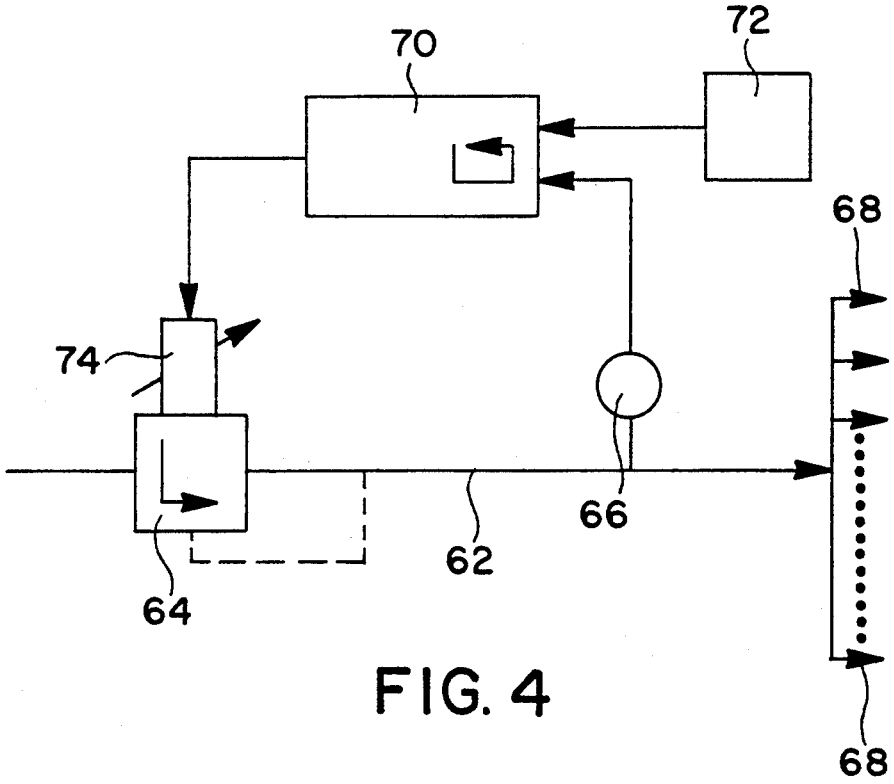
FIG. 4 shows an automatic pressure regulation system.

FIG. 4 shows a main 62 of the compressed air feed, which is led through a pressure control valve 64. After the branch to a measuring transducer 66 for the actual pressure, distribution lines 68 leading to the dies branch off from the main 62. The number of the distribution lines 68 corresponds to the number of dies in the casting machine, for example up to 36.

A controlled variable is led from the measuring transducer 66 to a processor 70. There, the controlled variable corresponding to the actual pressure is compared with a controlled variable calculated by a computer 72 for the desired pressure dependent on the metal level. If there is a relative pressure, that is to say a pressure differential between the desired and actual pressure, the processor triggers a signal denoted as the manipulated variable, which acts on the actuator 74 of the pressure control valve 64 and alters the latter depending upon the sign and absolute value of $\Delta p$ as determined. The actuator 74 can, for example, be a stepper motor or a d.c. motor.

This automatic pressure control is used for continuous computation of a desired value dependent on the metal level $H_1$ (FIG. 2), which is compared with the actual value of the air feed. By varying the pressure in the main 62, the pressure in the air cushion is automatically matched to an altered metal level.

Figure 5:
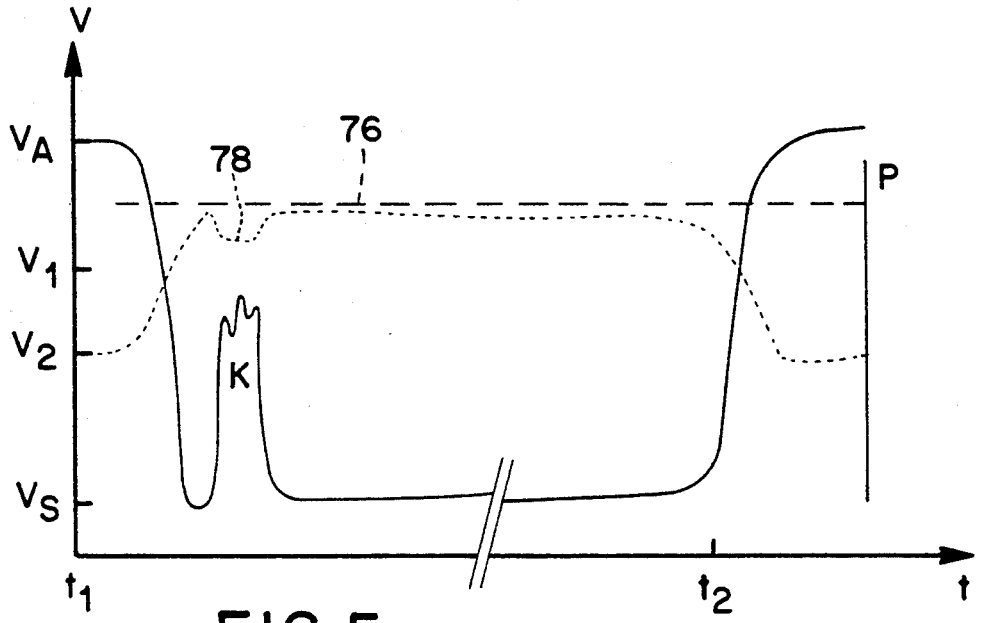
FIG. 5 shows the flow of air during casting.

The air flow V per unit time and die represented in FIG. 5 is plotted as a function of the casting time t. The air flow $V_A$ is relatively high at the start of casting $t_1$. The air flow falls relatively steeply with the inception of the feed of liquid metal and rising metal level. When the quantity of air $V_1$ is reached, with a delay of approximately 5 secs, a signal for withdrawing the die frame is triggered. In the present case, a cold run K occurs shortly after the minimum desired value $V_S$ of approximately 2 to 3 mbar has been reached. Air can escape between the die and the strand because of poor strand quality. After a short time, the quality is normal, the air flow drops once again to the minimum desired value $V_S$. At the end of pour, at time $t_2$, the metal level drops in the die, and the air flow V correspondingly rises rapidly. A signal for the end of pour is triggered when $V_2$ is reached.

The regulator pressure, in the present case 45 mbar in stationary normal operation, is given by a dashed line 76. The dotted line 78 shows the pressure variation after a length of 3 m in a main having a 6 mm internal diameter.

It is very plain from FIG. 5 that the air flow V is larger in the case of a lower pressure p in the main.

Figure 6:
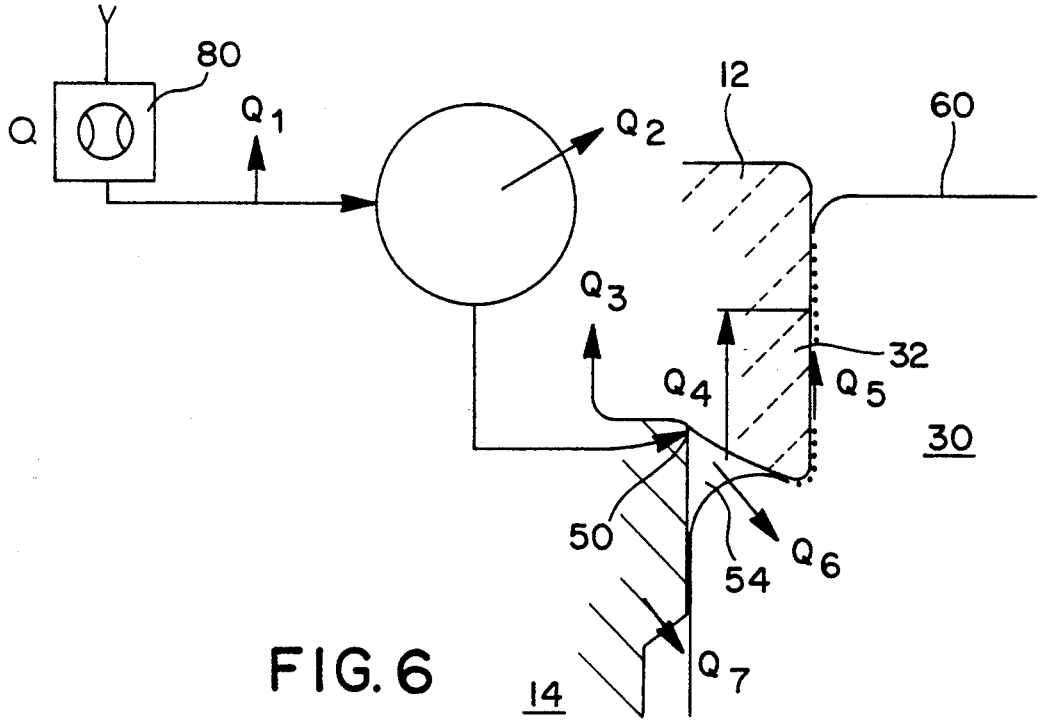
FIG. 6 shows the flow of air and the air losses.

FIG. 6 shows that the air flow Q corresponds to the sum of all the air losses. The air flow is determined by means of a flowmeter 80.

The losses between the flowmeter and the die, in lines, couplings, filters, valves, pressure regulators etc., are denoted by $Q_1$, the losses in the die itself by $Q_2$.

The following air losses occur in the region of the air cushion 54:

- $Q_3$: leaks between the insulating ring 32 and the die 14,
- $Q_4$: leaks in the insulating ring 32 (e.g. cracks),
- $Q_5$: bubble formation when the pressure of the air cushion is above the maximum permissible pressure,
- $Q_6$: reaction of the air with the melt and/or the lubricant,
- $Q_7$: leaks between the die and the cast strand (surface roughness of the strand, state of the die wall).

The losses $Q_1$ to $Q_4$ are caused by the state of the plant, and in the case of serviceable plants they must be negligibly small.

The air losses $Q_5$ and, in particular, $Q_7$ allow conclusions to be drawn concerning the quality of the cast strand.

As already mentioned, it is, of course, also possible to use other gases, in particular nitrogen or argon, instead of the air in the examples quoted. The essential features of the invention are not influenced thereby, although the loss $Q_6$ is eliminated.

We claim:

1. Process for feeding molten metal into dies, internally insulated in the upper region thereof, of an automatic continuous casting plant having a runner system, which comprises: providing a plurality of dies and a distributor trough communicating with the dies and runner system; feeding said dies with molten metal at the same metal level; providing an inner ring of said dies and maintaining a gas cushion that prevents direct contact of the dies with the molten metal in the region situated below said inner ring; injecting oil into the region of the inner ring; conducting said gas cushion via a joint main having distribution lines which conducts said gas cushion; and computing the relative pressure between a desired value computed by a program as a function of the metal level [$(H_2)$] measured via a level probe and an actual value measured in the main by means of a measuring transducer serving for program-controlled regulation and monitoring, and fulfilling a regulator function by means of a processor through the output of a signal for an actuator of a joint pressure control valve.

2. Process according to claim 1 wherein said gas cushion is air or inert gas.

3. Process according to claim 1 including the step of providing that said inner ring of said dies includes insulation and includes a bevel portion.

4. Process according to claim 1 wherein the variable external pressure is compensated.

5. Process according to claim 1 wherein said process obtains castings and including the step of withdrawing a die frame and stopping bases beneath the castings during the casting operation.

6. Process according to claim 5 wherein at the start of casting and without molten metal, the gas flow (V) per die reaches a first higher value ($V_A$) and, with flowing metal, the withdrawal of the die frame with the stopping bases is triggered shortly after the undershooting of a second, lower value ($V_1$) of the gas flow (V).

7. Process according to claim 6 wherein the first value ($V_A$) is about 12–15 Nl/min in the case of a set pressure of about 45 mbar, the second value ($V_1$) is about 8–10 Nl/min, and the delay after the second value has been reached is about 5 seconds.

8. Process according to claim 3 wherein the minimum and the maximum pressure in the gas cushion is set as a function of the metallostatic pressure, the minimum pressure being the function of the density of the molten metal, the acceleration due to gravity, the metal level, the interface strain of the molten metal in the region of the insulation and the surface tension of the molten metal in the region of the gas cushion, and the maximum pressure is a function of the density of the molten metal, the acceleration due to gravity and the depth of the bevel portion.

9. Process according to claim 1 wherein the same amount of oil is supplied per unit of time to all dies.

10. Process according to claim 9 wherein the oil is injected in pulses into the region of the gas cushion.

11. Process according to claim 1 including the step of automating the start-up and end of said feeding.

12. Device for feeding molten metal into dies, internally insulated at the upper region thereof, of an automatic continuous casting plant, which comprises: a runner system; a plurality of dies downstream of the runner system; a distributor trough feeding said dies communicating with said runner system with molten metal at the same metal level; an inner ring of said dies; a gas cushion that prevents direct contact of the dies with the molten metal maintained in the region situated below said inner ring; a main having a plant side and a computer side, said main being for the gas supply and having on the plant side a servo delivery valve and a measuring transducer, said measuring transducer having actual pressure controlled variables, and having on the computer side a processor which compares the actual pressure controlled variables of the measuring transducer and a controlled variable of a desired pressure, and triggers a manipulated variable for the actuator of the pressure control valve.

13. Device according to claim 12 including connecting lines leading exclusively directly to the dies, said lines branching off from the main.

14. Device according to claim 13 wherein the sum of the cross-section of all the connecting lines is below the cross-section of the main.

15. Device according to claim 14 wherein the sum of the cross-section of all the connecting lines is below the cross-section of the main by at least 20%.

16. Device according to claim 12 wherein said inner ring is an upper insulating ring of the dies, said insulating ring having an undercut on the underside thereof.

17. Device according to claim 16 wherein said undercut comprises a bevel with a depth ($H_2$) of about 10 mm.

* * * * *

UNITED STATES PATENT AND TRADEMARK OFFICE

CERTIFICATE OF CORRECTION

PATENT NO. : 5,170,838

DATED : December 15, 1992

INVENTOR(S) : JEAN-JAQUES THELER ET AL.

It is certified that error appears in the above-identified patent and that said Letters Patent is hereby corrected as shown below:

Column 7, claim 1, line 25, [($H_2$)] should be deleted.

Signed and Sealed this

Second Day of November, 1993

*Attest:*

Bruce Lehman

BRUCE LEHMAN

*Attesting Officer*

*Commissioner of Patents and Trademarks*